US006708698B2

(12) United States Patent
Catini

(10) Patent No.: US 6,708,698 B2
(45) Date of Patent: Mar. 23, 2004

(54) CURLER FOR HAIRSTYLES AND PERMANENT WAVES

(76) Inventor: Mauro Catini, Via Tasso 15, Civitanova Marche (Macerata) (IT)

( * ) Notice: Subject to any disclaimer, the term of this patent is extended or adjusted under 35 U.S.C. 154(b) by 0 days.

(21) Appl. No.: 09/993,043

(22) Filed: Nov. 14, 2001

(65) Prior Publication Data

US 2003/0089380 A1 May 15, 2003

(51) Int. Cl.[7] ..... A45D 2/14; A45D 2/00; A45D 2/08

(52) U.S. Cl. ..... 132/248; 132/245; 132/250

(58) Field of Search ..... 132/248, 247, 132/245, 246, 250, 251, 253

(56) References Cited

U.S. PATENT DOCUMENTS

| | | | | | |
|---|---|---|---|---|---|
| 2,309,373 | A | * | 1/1943 | Yven et al. | 132/247 |
| 2,499,285 | A | * | 2/1950 | Stimson | 132/248 |
| 2,796,872 | A | | 6/1957 | Mussy | |
| 3,431,917 | A | * | 3/1969 | Harris | 132/248 |
| 4,239,050 | A | * | 12/1980 | Leuzzi | 132/247 |
| 4,854,335 | A | * | 8/1989 | Lycett | 132/247 |
| 5,207,235 | A | * | 5/1993 | Muller et al. | 132/207 |
| 6,443,163 | B1 | * | 9/2002 | Merges | 132/262 |

FOREIGN PATENT DOCUMENTS

| | | |
|---|---|---|
| DE | 1810549 | 7/1969 |
| DE | 8911970 | 1/1991 |

* cited by examiner

*Primary Examiner*—John J. Wilson
*Assistant Examiner*—Robyn Kieu Doan
(74) *Attorney, Agent, or Firm*—William J. Sapone; Coleman Sudol Sapone, P.C.

(57) ABSTRACT

A curler for hairstyles and permanent waves includes an elongated body, with cross sections similar to an elliptical profile and changing continuously from a minimum to a maximum extension, in relation to a selected rate. The body has opposite heads and intermediate and central portions situated between said heads. An elastic strip is stretched longitudinally to the curler elongated body and touch the heads while leaving an open space in the remaining part of the curler elongated body for locks of hair to pass therethrough.

8 Claims, 3 Drawing Sheets

FIG. 5
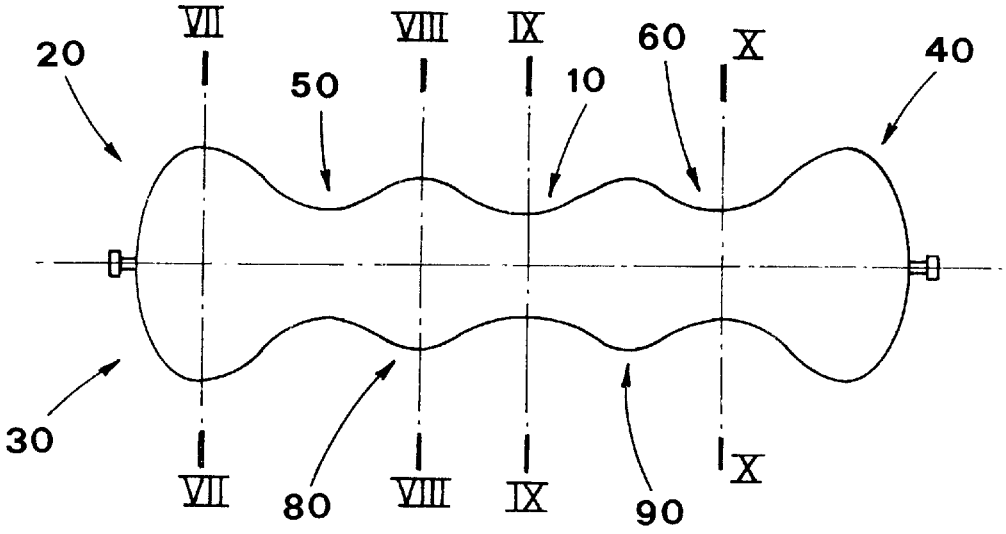
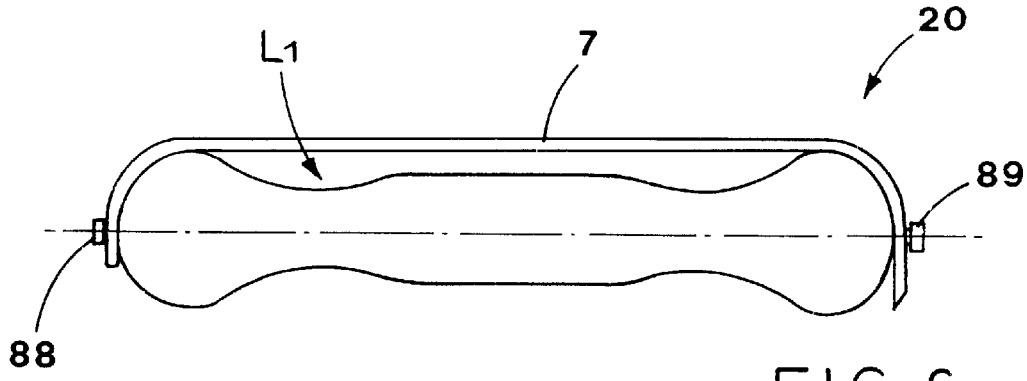
FIG. 6
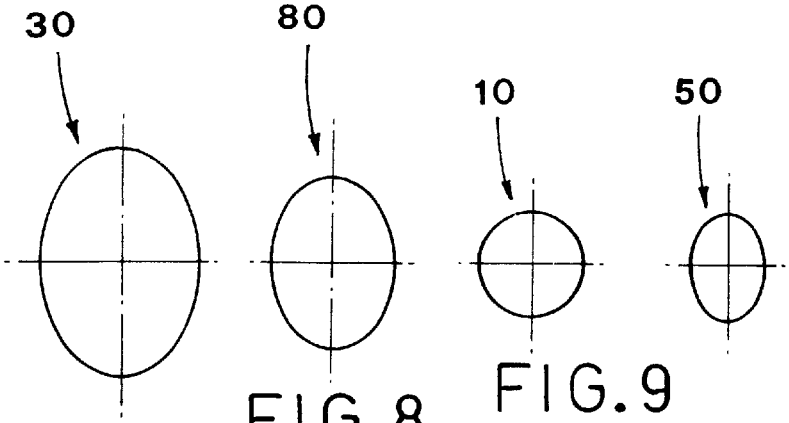
FIG. 7 FIG. 8 FIG. 9 FIG. 10

FIG.11
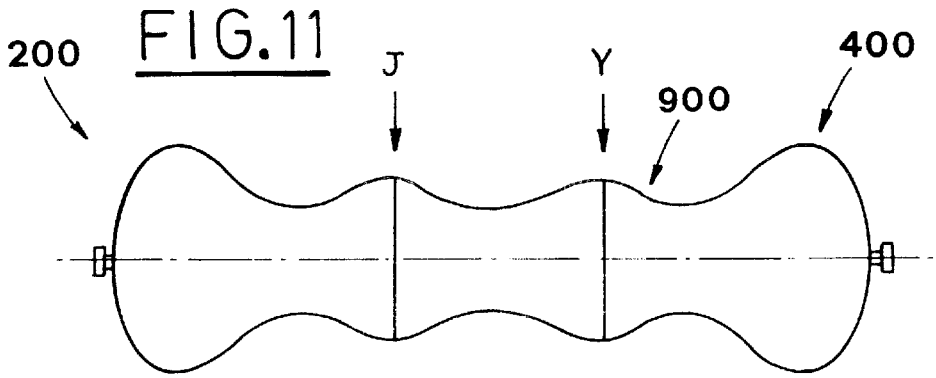
FIG.12
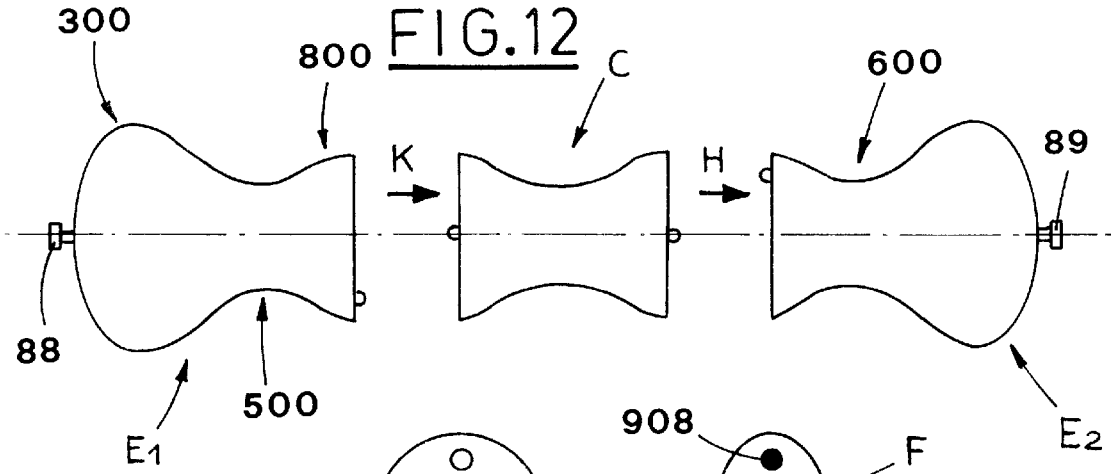
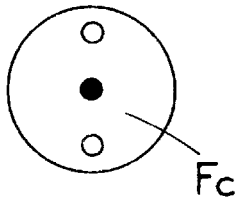
FIG.13
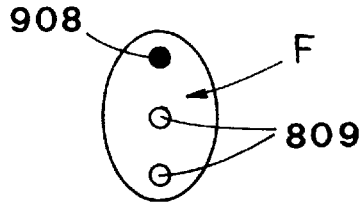
FIG.14
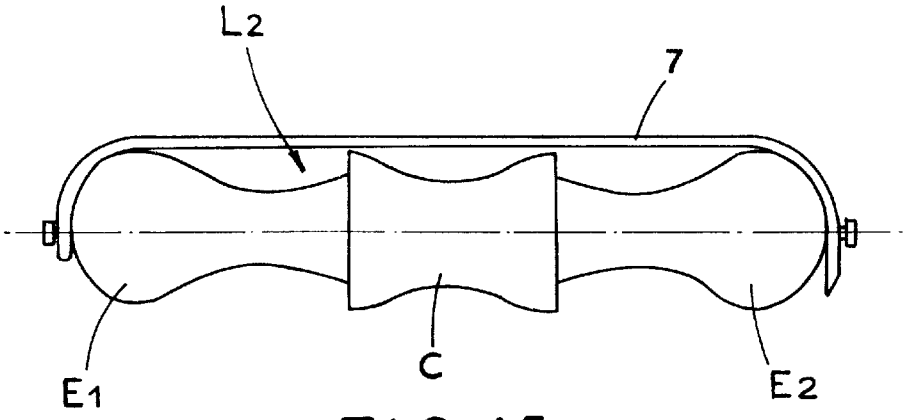
FIG.15

CURLER FOR HAIRSTYLES AND PERMANENT WAVES

FIELD OF THE INVENTION

The present invention relates to curlers for hairstyles and permanent waves.

DESCRIPTION OF THE PRIOR ART

Curlers of different sizes are known, adapted to be used by the operators of the field to perform particular "curled" hairstyles, or for permanent waves, with more or less waving according to the customer's desires.

A first type of curler includes a cylinder, with a stick introduced therein.

The ends of the stick protrude from the cylinder and have enlarged sections of different size.

The curler enlarged sections are adapted to lock a special small elastic strip extending longitudinally with respect to the cylinder and aimed at fixing the curler during use. The diameter of the intermediate portion of the cylinder reduces progressively, so as to facilitate the operator when rolling up a hair lock onto the curler.

A variant of this type of curler includes a cylindrical-shaped member at the ends of which corresponding covers are fastened. The central parts of the covers feature each a corresponding pin and a head, to which a suitable small elastic strip is fastened, which acts as described above.

A second type of curler is flat and has slightly curved walls, connected by two sides. The flat curler has a regular thickness for the entire extension, and a slight narrowing in the central part of the sides.

The heads of the above curler feature connecting members, integral therewith and aimed at longitudinally locking a stretched small elastic strip, which acts as described above.

A third type of curler includes two discs with a kind of barrel placed therebetween.

The discs feature in their central part connecting members, aimed at longitudinally locking a stretched small elastic strip, so as to block the curler during its use.

A fourth type of curler is formed by two parts: the first one includes a cylindrical element with pointed ends; the second part features a frame made of two bars, whose length is equal to the length of the cylindrical portion of the first part. The first and the second parts are joined by four circular strips.

Using this curler, the hair lock is rolled around the cylindrical element and locked by the frame applied to the cylindrical element with pressure.

Said curlers allow to obtain "curled" or waved hairstyles, depending on the type and size of curler used.

Even if performed with care and with particular techniques, the final hairstyle looks unnatural, that is to say, the difference between a natural curled/waved hairstyle and the one obtained artificially is visible.

Moreover, in the specific case of a permanent, where it is necessary to use acids for fixing the hairstyle, it happens that the shape of the curlers mentioned above and the pressure exerted by the elastic strip locking the hair lock damage the hair lock under the elastic strip (hair incision or cut).

If a waved permanent with a more natural effect is desired, a series of curlers of a different size must be used, with a consequent loss of time for the operator.

SUMMARY OF THE INVENTION

The object of the invention is to propose a curler with a simple design and low manufacturing costs, which allows to obtain as natural a hairstyle as possible.

Another object of the present invention is to propose a curler, whose shape allows to prevent damages to the hair, and avoids undesired folds in the hairstyle resulting from the pressure exerted by said elastic strip on the hair lock.

A further object of the present invention is to propose a curler which facilitates the operator in obtaining the desired results, accelerating the operation by reducing the quantity of curlers to be applied.

Yet a further object of the invention is to propose a hair curler which allows to obtain a varied waiving in the whole hair's length and a particularly accentuated waiving at the hair's ends.

The above mentioned objects are obtained by the present invention by means of a curler for hairstyles and permanent waves including an elongated body, symmetrical with respect to central vertical and horizontal planes, said body having, along its longitudinal extension, a cross section continuously changing from a minimum to a maximum extension and vice-versa at a selected rate.

BRIEF DESCRIPTION OF THE DRAWINGS

The characteristic features of the present invention will be pointed out in the following description with reference to the enclosed drawings, in which:

FIG. 5 shows a top view of an hair curler made according to a second embodiment;

FIG. 6 shows a lateral view of the hair curler of FIG. 5;

FIGS. 7 to 10 show cross-sectional views taken along lines VII—VII, VIII—VIII, IX—IX and X—X of FIG. 5, respectively;

FIG. 11 shows a top view of an hair curler made according to a third embodiment;

FIG. 12 is an exploded top view of the hair curler of FIG. 11;

FIG. 13 shows a view in accordance to the arrow K of FIG. 12;

FIG. 14 shows a view in accordance to the arrow H of FIG. 12;

FIG. 15 is a side view of the curler of FIG. 11.

DESCRIPTION OF THE PREFERRED EMBODIMENTS

Figure 1:
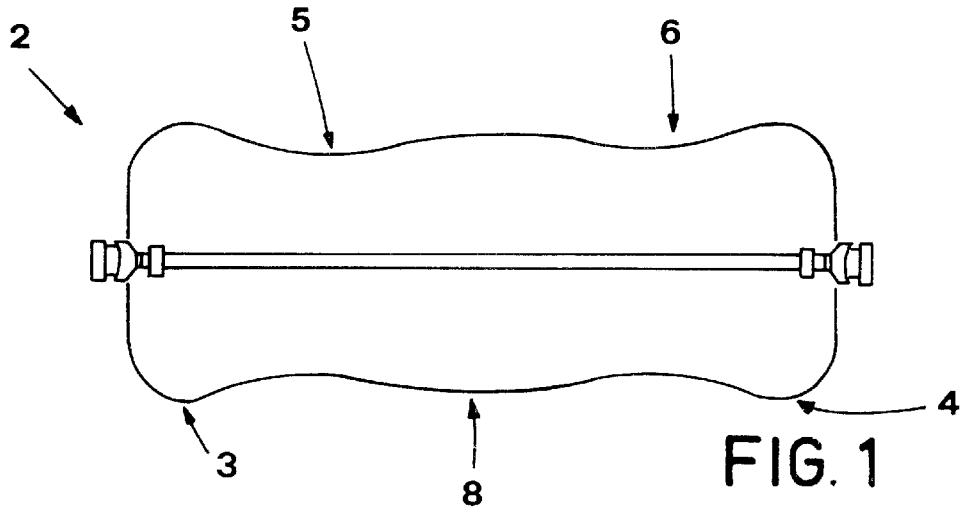
FIG. 1 is a top view of the proposed curler.

With reference to the enclosed drawings, the reference numeral 2 indicates a curler for hairstyles and permanent waves, which has an elongated shape, symmetrical with respect to the central vertical and horizontal planes.

The cross sections of the curler 2, along the longitudinal extension thereof, have a profile similar to an elliptical one with a continuously variable cross section area.

Figure 2:
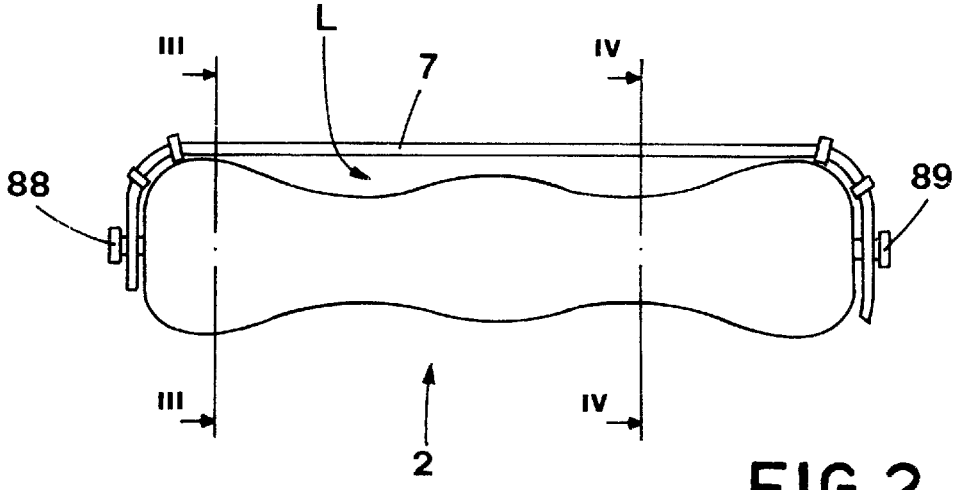
FIG. 2 is a lateral view of the proposed curler.
Figure 3:
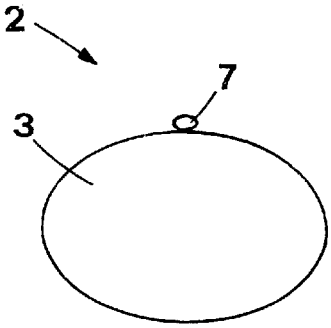
FIG. 3 is a section view taken along III—III of FIG. 2.
Figure 4:
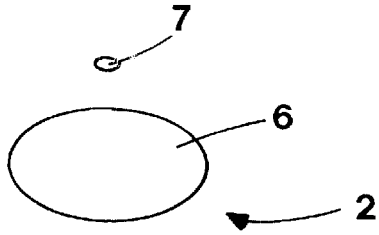
FIG. 4 is a section view taken along IV—IV of FIG. 2.

In the example shown in FIGS. 1, 2, the curler has two heads 3, 4, connected to a central portion 8 by two narrow portions 5, 6; the cross section of the central portion is smaller than the maximum cross section of the heads.

At its ends, the curler 2 features, made integral and concentric therewith, connecting members 88, 89, protruding outwards.

A small elastic strip 7 (of known type), stretched longitudinally with respect to the curler, is removably fastened to the connecting members.

The small elastic strip 7 is in contact only with the heads 3, 4, in the region of the maximum section thereof, while it does not touch the remaining part of the curler due to the particular shape of the curler, which leaves an open space L, through which the hair rolled on the curler pass.

Thus, the pressure exerted on the hair by the small strip 7 is considerably reduced.

Reference numeral 20 indicates the curler of the present invention, made in accordance to a second embodiment.

In the example shown in FIGS. 5 and 6, the curler ha two heads 30, 40 and two intermediate enlarged portions 80, 90 connected to the heads by intermediate narrow portions 50, 60.

The maximum cross section of the intermediate enlarged portions 80, 90 is smaller than the cross section of the heads. The cross section of both the intermediate enlarged portions (FIG. 8) and the heads (FIG. 7) has quasi elliptical shape. The cross-sectional area varies in stepless way.

The two of the intermediate enlarged portions 80, 90 are connected to each other by a central narrow portion 10, which has a circular cross-section. The circular cross-section of the central narrow portion is smaller that the cross-section of the heads and its diameter is substantially equal to the largest dimension of the intermediate narrow portions 50, 60.

At the heads, the curler 20 has, made integral and concentric therewith, connecting members 88, 89, protruding outwards, to which the small elastic strip 7 is removably fastened, stretched longitudinally with respect to the curler The elastic strip 7 touches only the heads 30, 40, in the points where they have the largest cross-section, and, due to the particular shape of the curler, a space L1 is left between the strip and the reminder of the curler for the hair to pass therethrough.

Reference numeral 200 indicates a third embodiment of the present hair curler.

Considering its longitudinal extension, this third kind of curler has two cross-cuttings J, Y (FIG. 11) which define two end portions E1, E2 and one central portion C of the curler.

The two of the curler end portions E1, E2 have a cross-section similar to the elliptical one already mentioned, varying in the longitudinal direction in stepless way.

The curler central portion C has a substantially circular cross-section with a stepless varying area, which is larger at the sides and smaller at the middle part.

The two of the curler end portions E1, E2 are fastened to the curler central portion C.

In the example shown in FIGS. 11 to 15, the curler end portions E1, E2 have respective heads 300, 400 which are connected to related enlarged portions 800, 900 by means of respective intermediate narrow portions 500, 600.

At the cross-cutting J, Y, the enlarged portions 800, 900 have respective facings F (FIG. 14), which have first fastening means formed e.g. by pins 908 and holes 909.

The curler central portion C has two facings Fc at its sides, which facings Fc have circular shape. The facings Fc have second fastening means, which match with the first fastening means of the enlarged portions.

At the heads, the curler 200 has, made integral and concentric therewith, connecting members 88, 89, protruding outwards, to which the small elastic strip 7 is removably fastened, stretched longitudinally with respect to the curler The elastic strip 7 touches only the heads 300, 400, in the points where they have the largest cross-section, and, due to the particular shape of the curler, a space L2 is left between the strip and the reminder of the curler for the hair to pass therethrough.

In non-use condition, the small elastic strip 7 of the curler 2, 20, 200 is coupled to the connecting members 88, 89; before using the curler, an operator must release the small elastic strip 7 from one of the connecting members, for example from member 89.

Then, the operator rolls a hair lock onto the curler, and locks the latter together with the hair lock, by hooking the small elastic strip 7 to the same connecting member 89.

It is to be pointed out that the curler 2 of the first embodiment and the curler 20 of the second embodiment are proposed in different sizes, needed to perform the required hairstyles on different hair lengths.

Also, it should be noted that the end portions E1, E2 as well as the central portion C of the curler 200 can be produced with different sizes, which can be mixed, changed and coupled in accordance with the necessity of the user.

The first embodiment of the curler for hairstyles and permanents herein described is particularly advantageous because of its elongated shape, symmetrical with respect to the horizontal and vertical planes, with cross sections having a profile similar to an elliptical area with a variable cross section, which allows to obtain hairstyles or permanents with a more natural look.

The natural effect is obtained due to the fact that the hair lock that the operator rolls onto the curler has areas with a different waving; more precisely, the waves are more marked for the hair rolled at the narrow portions 5, 6, and less marked for the hair rolled on the central portion 8.

The second and third embodiments of the curler for hairstyles and permanents herein described are capable of making waiving which resemble very natural along the whole hair's length. More precisely, the waiving is more accentuated in the hair wound around the narrow portions 50, 60;500, 600 and less accentuated in the hair wound around the enlarged portions 800, 900.

Moreover, the fact that the central portions have a circular cross-section and that a hair lock is wound thereon, makes it possible to obtain a more accentuated waiving at the ends, so as to increase the natural resembling effect.

The proposed curler allows to obtain waves with a natural effect, since all the curlers used by the operator have identical size, thus allowing the operator to save time when applying the same.

Moreover, the number of curlers to apply is reduced, thus obtaining a better final result; in fact, as different waves are obtained on each curler, it is no longer necessary to apply a series of curlers of different size to obtain a similar effect.

The shape of the curler is advantageous also because the pressure of the elastic strip 7 on the rolled hair lock is very slight, which allows to avoid undesired folds near the elastic strip and, in case hairstyle fixing acids are used, the hair lock under the elastic strip is not damaged.

It is understood that what above, has been described as a pure, unlimited example, therefore, possible variants of the invention remain within the protective scope of the present technical solution, as described above and claimed hereinafter.

What is claimed is:

1. A curler for hairstyles and permanent waves comprising an elongate body having an elliptical cross sectional shape in at least a portion thereof, the elongate body symmetrical with respect to central vertical and horizontal planes, said elongate body having two heads at the ends thereof, each head having a maximum cross section and at least one intermediate circumferential wave forming portion having a lesser circumferential cross section than the heads, provided between the heads, separated from the heads by at least two wave forming narrow portions of lesser cross section than the intermediate portion, such that hair rolled on the curler has a more marked wave on the wave forming narrow portions than on the intermediate wave forming portion.

2. The curler of claim 1 further comprising elastic means engageable with said heads and stretched longitudinally with respect to said elongate body, said elastic means touching said heads only in the region of a maximum section thereof, an open space being provided between the elastic means and a remaining part of said elongate body for rolled hair to pass therebetween.

3. The curler of claim 1 wherein said elongate body has a circular cross-section in the intermediate portion and an elliptical cross section in the remainder of the elongate body.

4. The curler of claim 1 wherein said elongate body has two intermediate portions having a lesser cross section than the heads; the two narrow portions connecting said heads to said intermediate enlarged portions, and further comprising a central narrow portion for connecting said intermediate enlarged portions to one another, the central narrow portion having a cross-section smaller than a largest cross wise section of said heads, and having a diameter equal to the largest cross wise section of said narrow portions.

5. The curler of claims 4 further comprising elastic means engageable with said heads and stretched longitudinally with respect to said elongate body, said elastic means touching said heads only in a region of a maximum section thereof, an open space being provided between the elastic means and a remaining part of said elongate body for rolled hair to pass therebetween.

6. The curler of claim 1 wherein said elongate body comprises two separated end portions and a central portion connected to said end portions, each end portion having:

one head having an enlarged portion; and, an intermediate narrow portion for connecting said head to said enlarged portion; each enlarged portion having a facing and first fastening means and said central portion having two opposite facings and second fastening means capable of coupling with said first fastening means.

7. The curler of claim 6 further comprising elastic means engageable with said heads and stretched longitudinally with respect to said elongate body, said elastic means touching said heads only in the region of a maximum section thereof, an open space being provided between the elastic means and a remaining part of said elongate body for rolled hair to pass therebetween.

8. The curler of claim 1, wherein said body has a pair of opposite ends, connecting members protruding outwards from said opposite ends, elastic means removably fastened to said connecting members.

* * * * *